US011466898B1

(12) United States Patent
Blichmann

(10) Patent No.: US 11,466,898 B1
(45) Date of Patent: Oct. 11, 2022

(54) BOILER APPARATUS AND METHOD THEREOF

(71) Applicant: Blichmann Engineering, LLC, Lafayette, IN (US)

(72) Inventor: John Blichmann, Lafayette, IN (US)

( * ) Notice: Subject to any disclaimer, the term of this patent is extended or adjusted under 35 U.S.C. 154(b) by 267 days.

(21) Appl. No.: 16/588,908

(22) Filed: Sep. 30, 2019

Related U.S. Application Data

(60) Provisional application No. 62/738,125, filed on Sep. 28, 2018.

(51) Int. Cl.

| | |
|---|---|
| ***F24H 9/1818*** | (2022.01) |
| ***F24H 1/50*** | (2022.01) |
| ***F24H 1/20*** | (2022.01) |
| ***F24H 9/00*** | (2022.01) |
| ***F24H 1/22*** | (2022.01) |

(52) U.S. Cl.
CPC ..... *F24H 9/1818* (2013.01); *F24H 1/202* (2013.01); *F24H 1/22* (2013.01); *F24H 1/50* (2013.01); *F24H 9/0005* (2013.01); *F24D 2200/08* (2013.01)

(58) Field of Classification Search
CPC ..... F24H 9/1818; F24H 9/0005; F24H 1/202; F24H 1/22; F24H 1/50; F24D 2200/08
See application file for complete search history.

(56) References Cited

U.S. PATENT DOCUMENTS

| | | | | |
|---|---|---|---|---|
| 4,110,600 | A * | 8/1978 | Spotts | F24H 3/0417 126/110 AA |
| 4,594,801 | A * | 6/1986 | Gronwick | D06F 75/18 16/429 |
| 2010/0203209 | A1* | 8/2010 | Fishbein | A47J 31/18 426/433 |
| 2011/0095017 | A1* | 4/2011 | Steurer | H02J 3/14 219/493 |
| 2014/0234482 | A1* | 8/2014 | Kempfert | C12C 13/10 426/16 |
| 2017/0095749 | A1* | 4/2017 | Sammons | B01D 3/003 |
| 2019/0059412 | A1* | 2/2019 | Jacobs | A47J 31/20 |

* cited by examiner

*Primary Examiner* — Steven S Anderson, II
(74) *Attorney, Agent, or Firm* — Gutwein Law; Tyler B. Droste

(57) ABSTRACT

An improved boiler apparatus having multiple resistive heating elements are provided with fixed resistances that can be rewired to allow dual voltage capability and at the same time, reduced watt density. For 120 V operation, the large diameter 9 ohm coil is used alone to provide the lowest possible watt density. For 240 V operation, all three heating coils are wired in series, creating a low watt density but high wattage heater.

14 Claims, 6 Drawing Sheets

BOILER APPARATUS AND METHOD THEREOF

CROSS-REFERENCE TO RELATED APPLICATION

This U.S. Patent Application Patent application claims priority to U.S. Provisional Application 62/738,125 filed Sep. 28, 2018 the disclosure of which is considered part of the disclosure of this application and is hereby incorporated by reference in its entirety.

FIELD OF THE INVENTION

This invention relates generally to electric heating elements and boilers.

BACKGROUND

It is known is well known in the home beer brewing art to boil beer for sterilization, isomerization of the hops and other beneficial results. In addition, it is desired by the market to use convenient electric heating for such boilers as it produces no hazardous fumes and excessive heat that propane and natural gas burners used as heat sources do. Large electric coffee urns are known in the art to use for such a boiler. These current art urns are single voltage designs that are either 120V or 240V. The limitations of 120V is that only 15 A receptacles are available in most homes limiting max power to about 1500 W. Subsequently heating times are excessively long and the boil intensity is very low leading to undesirable flavors in the finished beer such as dimethyl sulfide (DMZ). However, 240V units can reach 2500 W or more creating fast heating times and excellent boil intensity. Most homes have access to 240V power through the main power panel, dryers, ovens etc. But it may be located in an inconvenient area for brewing.

As the urns are normally heating water for coffee and tea, watt density is not an issue. For beer brewing, the sugars will scorch if the watt density is too high and this, in turn, will caramelize (discolor) and alter the flavor in an undesirable way. Therefore it is an object of this invention to allow dual voltage capability without changing the heating elements. It is a second objective of this product to reduce the effective watt density to greatly reduce the chances of scorching.

BRIEF SUMMARY OF THE INVENTION

In one aspect, this disclosure is related to an improved boiler apparatus including a kettle portion and a heating element portion. The kettle portion can include an interior, an exterior surface, a bottom end and a top end. The heating element portion can include a heating element assembly comprising a first coil having a first diameter and a first resistance coupled to a sub plate, a control panel, a switch configured to adjust the voltage supplied to the heating element assembly from a first voltage to a second voltage, wherein the heating element assembly is coupled to the bottom end of the kettle portion.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
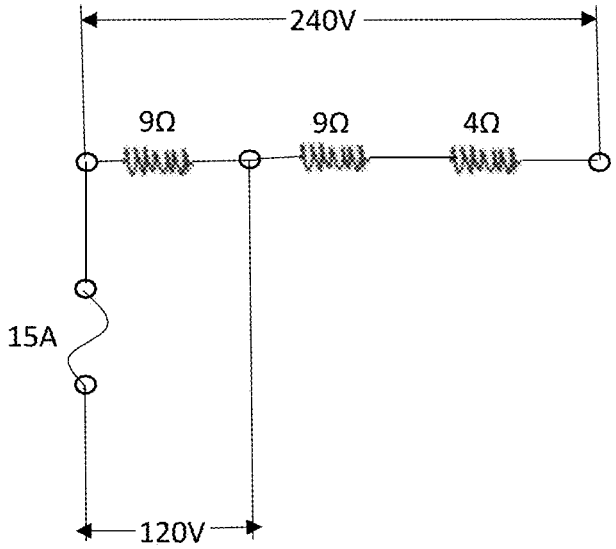
FIG. 1 is a schematic of an exemplary resistive heating element having dual voltage capability of the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 2A:
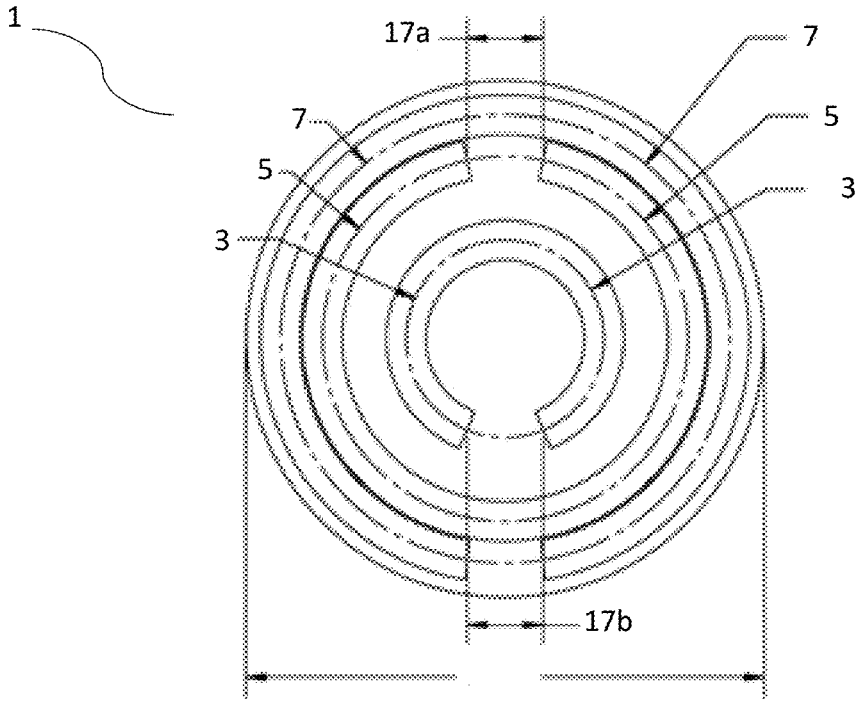
FIG. 2A is a top view of an exemplary embodiment of a heating element assembly having plurality of coils.
Figure 2B:
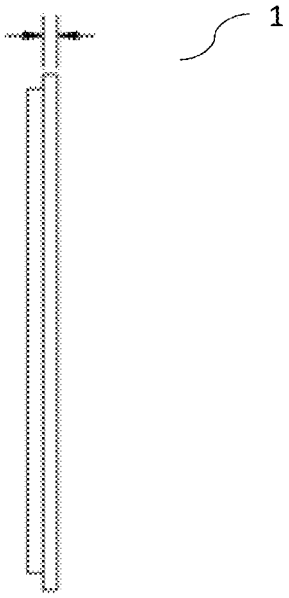
FIG. 2B is a side view of an exemplary embodiment of a heating element assembly having plurality of coils.
Figure 2C:
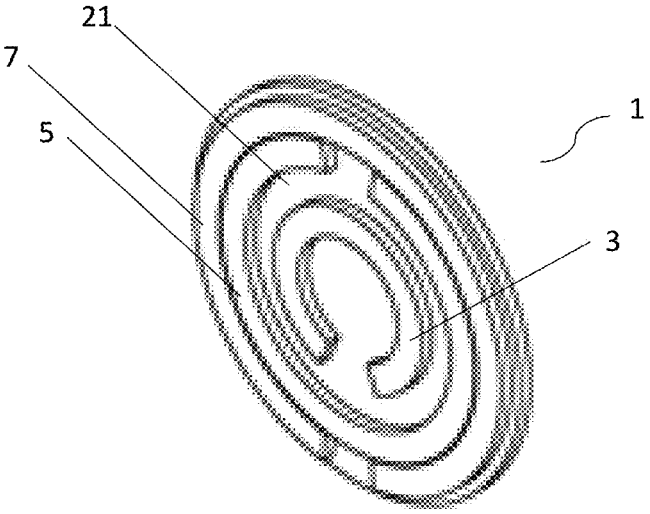
FIG. 2C is a perspective view of an exemplary embodiment of a heating element assembly having plurality of coils.
Figure 3:
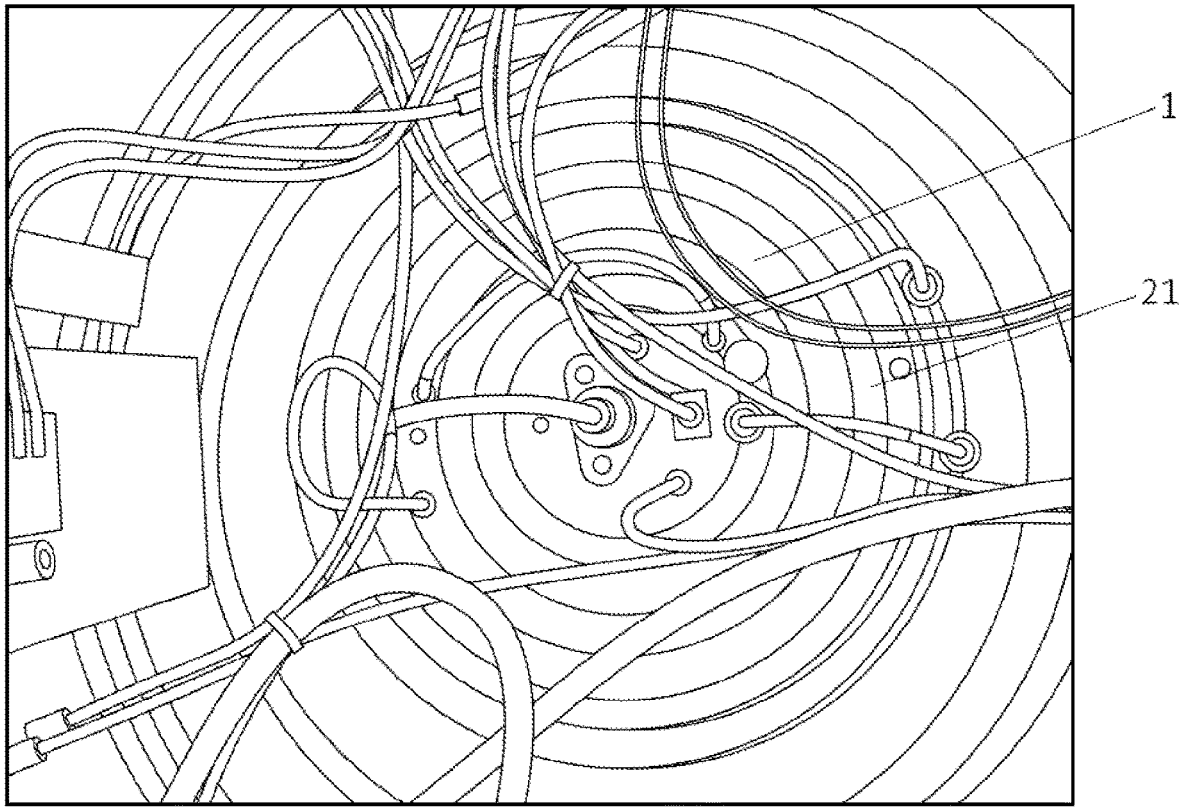
FIG. 3 is a view of an exemplary embodiment of a heating element assembly having plurality of coils.
Figure 4:
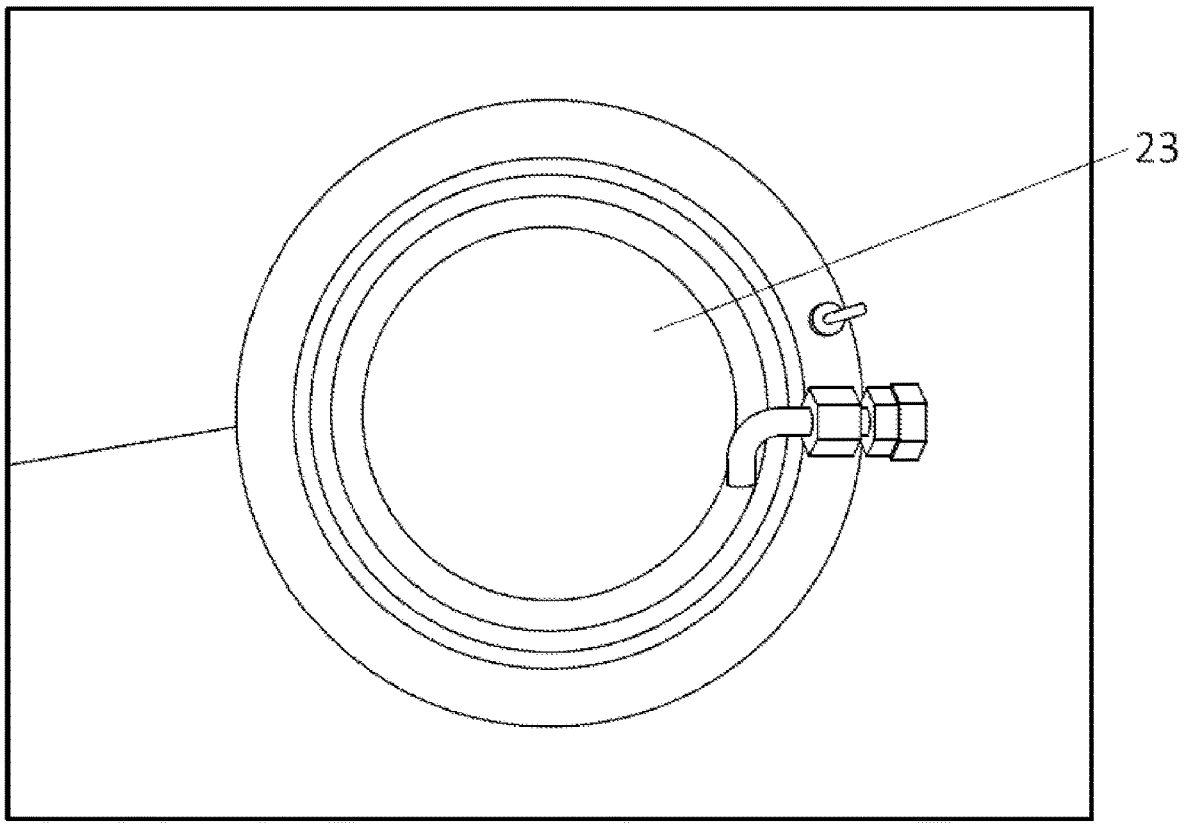
FIG. 4 is an interior view of the kettle portion of the present disclosure.
Figure 5:
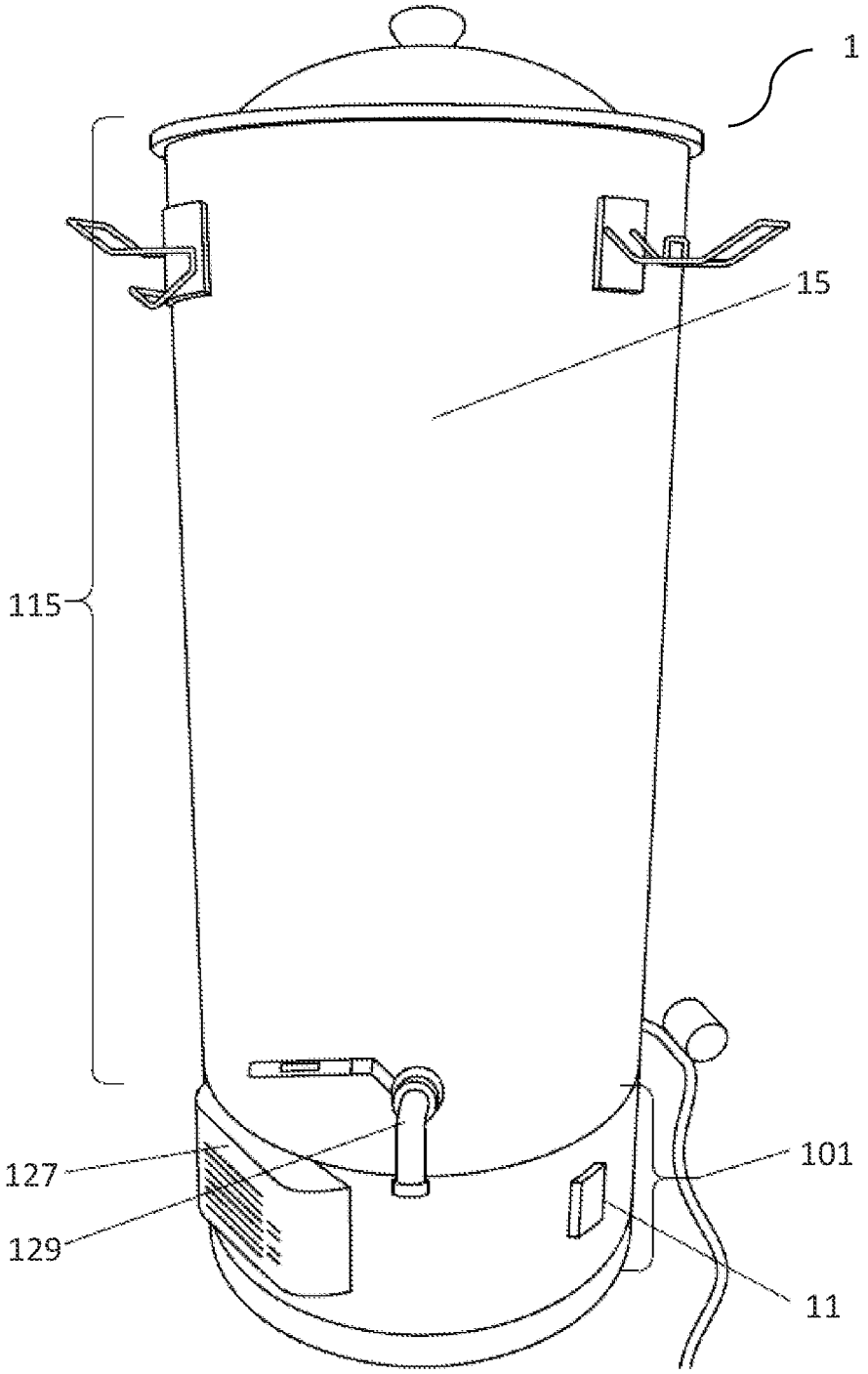
FIG. 5 is a perspective view of an improved boiler apparatus of the present disclosure.

As shown in FIG. 1, a heating element assembly can include multiple resistive heating elements are provided with fixed resistances that can be rewired to allow dual voltage capability, such as 120 v and 240 v operations, and at the same time, reduced watt density. Any number of heating element coils can be used. In some embodiments, the heating element assembly can include a first coil 3 and a second coil 5. In one exemplary embodiment, the heating element 1 can have about 3 individual coil heating elements, including a first coil 3, a second coil 5, and a third coil 7. The first coil can have a first diameter and a first resistance, the second coil can have a second diameter and a second resistance, and the third coil can have a third diameter and a third resistance. In some exemplary embodiments, the first diameter is less than the second diameter. In some exemplary embodiments, the second coil and third coil can have the same resistance. In some embodiments, the first coil can have a lower resistance than the second coil and third coil. In one exemplary embodiment, third coil can have a diameter of about 150 mm and a resistance of about 9 ohms, the second coil can have a diameter of about 110 mm and a resistance of about 9 ohms, and the first coil can have a diameter of about 60 mm and a resistance of about 4 ohms. The three coils can have various resistances and diameters depending upon the applications and input voltage. For 120V operation, the coil 7 can have a larger diameter can be about a 9-ohm coil, which may be used alone to provide the lowest possible watt density for a user's desired application. For 240V operation, all three heating coils can be wired in series, as shown in FIG. 3, creating a low watt density but high wattage heater. A switch 11 can be used to allow a user to quickly convert from 120V to 240V operation. As shown in FIG. 2 and FIG. 3, the heating elements are designed with space between them so that the heat can spread out over the aluminum sub plate 21 that the elements are bonded to. This aluminum plate/heater assembly 1 can be bonded to the bottom side 13 of the bottom end 23 of an urn or kettle 15. Prior art units used a thin aluminum bonding plate (approx. 1 mm). One exemplary embodiment of the present invention can utilize a very thick plate 1 about 3 to about 10 mm or about 4 to about 6 mm or about 5 mm thick (FIG. 2*b*) to allow the heat to spread to a larger area on the bottom 13 of the urn 15. In addition, the element electrical connection ends 17*a,b* can be alternated about 180 degrees to allow the heat to spread more evenly on the aluminum plate. FIGS. 4-5 are images of exemplary embodiments of a boiler apparatus 100 of the present disclosure. The boiler apparatus can include a kettle portion 115 and a heating element portion 101. The heating element portion 101 can include the various heating elements and coils as well as the circuitry connecting the various coils. The heating element portion can also include a control panel 127 wherein the control panel 127 is communicatively coupled to the heating element 1 and coils and can be configured to control the amount of voltage being applied to the heating coil 1. A switch 11 can also be included in the heating element portion 101 to allow a user to toggle between two different voltages. The switch can optionally be communicatively coupled to the control panel 127. The control panel can further include wireless technology, such as a transceiver to allow user to communicated to the control panel using any suitable wireless communication. In some exemplary embodiments, the voltages can be 120 v and 240 v. The kettle portion 115 can include one or more valves 129 fluidly connected to the interior of the kettle 15.

It is understood that many combinations of multiple elements, resistances, dimensions, configurations, and bonding plate thicknesses and diameters are possible to achieve these results.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. An improved boiler apparatus comprising:

a kettle portion having an interior, an exterior surface, a bottom end and a top end; and a heating element portion having a heating element assembly comprising a first coil having a first diameter, a first resistance, a second heating element having a second diameter, a second resistance, and a second electrical connection end, wherein the second diameter is greater than the first diameter, wherein both the first heating element and second heating element are coupled to a sub plate, wherein there is a pre-determined amount of space between the first heating element and the second heating element and the first electrical connection end and second connection end are alternated 180 degrees from each other, wherein the spacing of the first heating element and second heating element and alternated connection ends of the heating elements are configured to provide evenly distributed heat over the surface of the sub plate, a control panel, a switch configured to adjust the voltage supplied to the heating element assembly from a first voltage to a second voltage, wherein the heating element assembly is coupled to the bottom end of the kettle portion.

2. The improved boiler apparatus of claim 1, further comprising at least one valve fluidly connected to the interior.

3. The improved boiler apparatus of claim 1, wherein the second resistance is greater than the first resistance.

4. The improved boiler apparatus of claim 3, further comprising a third coil having a third diameter and a third resistance.

5. The improved boiler apparatus of claim 4, wherein the third diameter is greater than the second diameter.

6. The improved boiler apparatus of claim 5, wherein the third resistance is the same as the second resistance.

7. The improved boiler apparatus of claim 6, wherein the second resistance is 9 ohms.

8. The improved boiler apparatus of claim 7, wherein the first resistance is 4 ohms.

9. The improved boiler apparatus of claim 8, wherein the first voltage is 120 volts and the second voltage is 240 volts.

10. The improved boiler apparatus of claim 9, wherein the control panel is communicatively coupled to the switch and the heating plate assembly.

11. The improved boiler apparatus of claim 10, wherein the control panel includes a transceiver.

12. The improved boiler apparatus of claim 11, wherein the heating element portion is coupled to the bottom of the kettle portion.

13. The improved boiler apparatus of claim 12, wherein the first coil, second coil, and third coil are bonded to the sub plate, wherein the subplate is comprised of aluminum and has a thickness of 5 mm.

14. The improved boiler apparatus of claim 1, wherein the first heating element and second heating element are configured to have a low watt density to prevent scorching of a liquid within the vessel.

* * * * *